US006254483B1

(12) United States Patent
Acres

(10) Patent No.: US 6,254,483 B1
(45) **Date of Patent: *Jul. 3, 2001**

(54) METHOD AND APPARATUS FOR CONTROLLING THE COST OF PLAYING AN ELECTRONIC GAMING DEVICE

(75) Inventor: John F. Acres, Corvallis, OR (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/086,964

(22) Filed: May 29, 1998

Related U.S. Application Data

(60) Continuation of application No. 08/465,717, filed on Jun. 6, 1995, which is a division of application No. 08/322,172, filed on Oct. 12, 1994, now Pat. No. 5,655,961.

(51) Int. Cl.[7] ..... A63F 9/24

(52) U.S. Cl. ..... 463/26; 463/23; 463/25

(58) Field of Search ..... 463/16, 17, 18, 463/19, 20, 23, 25, 40, 41, 42

(56) References Cited

U.S. PATENT DOCUMENTS

| | | | |
|---|---|---|---|
| 3,598,964 | 8/1971 | Dell | 235/61.6 R |
| 3,659,284 | 4/1972 | Rusch | 340/324 A |
| 3,796,433 | 3/1974 | Fraley et al. | 273/138 A |

(List continued on next page.)

FOREIGN PATENT DOCUMENTS

| | | |
|---|---|---|
| B-27572/84 | 11/1984 | (AU) . |
| B 53370/86 | 8/1986 | (AU) . |
| B-71194/91 | 8/1991 | (AU) . |
| B-10488/92 | 7/1992 | (AU) . |
| B 13023/92 | 9/1992 | (AU) . |
| B-20986/92 | 1/1993 | (AU) . |
| 21618/95 | 1/1996 | (AU) . |
| 48323/97 | 6/1998 | (AU) . |
| 2 151 054 | 7/1985 | (GB) . |
| 2 211 975 | 7/1989 | (GB) . |
| 2211975 | 7/1989 | (GB) . |
| WO 94/12256 | 6/1994 | (WO) . |
| WO 95/22811 | 8/1995 | (WO) . |
| WO 95/30944 | 11/1995 | (WO) . |
| WO 98/35309 | 8/1998 | (WO) . |
| WO 98/40140 | 9/1998 | (WO) . |

OTHER PUBLICATIONS

Report & Recommendation (Findings of Fact & Conclusions of Law Re: Claim Construction), May 2000.

Expert Report of Michael J. Bennett Pursuant to Fed. R. Civ. P. 26(A(2) (sic), Feb. 1999.

(List continued on next page.)

*Primary Examiner*—Jessica J. Harrison
*Assistant Examiner*—John M. Hotaling, II
(74) *Attorney, Agent, or Firm*—Marger Johnson & McCollom, PC

(57) ABSTRACT

Electronic gaming machines, such as slot machines or video poker machines are interconnected by a computer network. The behavior of each machine is controlled by configuring selected parameters such as game speed, payback percentage, or game appearance. As the machines are played, any of the selected parameters may be changed responsive to commands issued over the network. The commands are issued in response to predetermined changes in variables such as rate of play, player status, and the time of the day, week, or month. The payback percentage may be changed by implementing a new pay table at the selected machine or machines or by implementing a bonus period during which a percentage of all money played on the selected machines accrues in a bonus pool. During the bonus period, the selected machines are eligible for bonus awards that may be random or related to jackpots paid based on the pay tables in the selected machines.

54 Claims, 4 Drawing Sheets

U.S. PATENT DOCUMENTS

| | | | |
|---|---|---|---|
| 3,819,186 | 6/1974 | Hinterstocker | 273/138 A |
| 4,072,930 | 2/1978 | Lucero | 340/152 T |
| 4,230,265 | 10/1980 | Casaly | 235/455 |
| 4,258,838 | 3/1981 | Rockola et al. | 194/1 R |
| 4,283,709 | 8/1981 | Lucero et al. | 340/147 R |
| 4,335,809 | 6/1982 | Wain | 194/1 R |
| 4,409,656 | 10/1983 | Anderson | 364/200 |
| 4,467,424 | 8/1984 | Hedges et al. | 364/412 |
| 4,575,622 | 3/1986 | Pellegrini | 235/382 |
| 4,582,324 | 4/1986 | Koza et al. . | |
| 4,624,459 | 11/1986 | Kaufman | 273/143 R |
| 4,636,951 | 1/1987 | Harlick | 364/412 |
| 4,652,998 | 3/1987 | Koza et al. | 364/412 |
| 4,669,596 | 6/1987 | Capers et al. | 194/210 |
| 4,669,730 | 6/1987 | Small | 273/138 |
| 4,679,143 | 7/1987 | Hagiwara | 364/412 |
| 4,760,247 | 7/1988 | Keane et al. | 235/454 |
| 4,760,527 | 7/1988 | Sidley | 364/412 |
| 4,764,666 | 8/1988 | Bergeron | 235/380 |
| 4,775,937 | 10/1988 | Bell | 364/412 |
| 4,805,907 | 2/1989 | Hagiwara | 273/138 A |
| 4,815,741 | 3/1989 | Small | 273/138 A |
| 4,837,728 | 6/1989 | Barrie et al. | 364/412 |
| 4,839,640 | 6/1989 | Ozer et al. | 340/825.31 |
| 4,844,464 | 7/1989 | Berge | 138/273 A |
| 4,856,787 | 8/1989 | Itkis . | |
| 4,880,237 | 11/1989 | Kishishita | 273/138 A |
| 4,882,473 | 11/1989 | Bergeron et al. | 235/380 |
| 4,922,420 | 5/1990 | Nakagawa et al. . | |
| 4,926,327 | 5/1990 | Sidley | 364/412 |
| 4,926,996 | 5/1990 | Eglise et al. . | |
| 4,948,138 | 8/1990 | Pease et al. . | |
| 4,964,638 | 10/1990 | Ishida | 273/138 A |
| 4,991,848 | 2/1991 | Greenwood et al. | 273/143 R |
| 5,007,649 | 4/1991 | Richardson | 273/237 |
| 5,016,880 | 5/1991 | Berge | 138/273 A |
| 5,038,022 | 8/1991 | Lucero | 235/380 |
| 5,042,810 | 8/1991 | Williams | 273/142 |
| 5,043,887 | 8/1991 | Richardson . | |
| 5,072,381 | 12/1991 | Richardson et al. . | |
| 5,078,405 | 1/1992 | Jones | 273/309 |
| 5,096,195 | 3/1992 | Gimmon | 273/138 A |
| 5,103,081 | 4/1992 | Fisher et al. | 235/464 |
| 5,116,055 | 5/1992 | Tracy | 273/138 A |
| 5,123,649 | 6/1992 | Tiberio | 273/143 R |
| 5,129,652 | 7/1992 | Wilkinson | 273/139 |
| 5,135,224 | 8/1992 | Yamamoto et al. | 273/143 R |
| 5,159,549 | 10/1992 | Hallman, Jr. et al. . | |
| 5,179,517 | 1/1993 | Sarbin et al. | 364/410 |
| 5,197,094 | 3/1993 | Tillery et al. | 379/91 |
| 5,216,613 | 6/1993 | Head, III | 369/275.2 |
| 5,217,224 | 6/1993 | Sincock | 273/138 A |
| 5,224,706 | 7/1993 | Bridgeman et al. . | |
| 5,242,163 | 9/1993 | Fulton | 273/85 CP |
| 5,249,800 | 10/1993 | Hilgendorf et al. | 273/138 A |
| 5,257,159 | 10/1993 | DeMar | 364/410 |
| 5,265,874 | 11/1993 | Dickinson et al. | 273/138 A |
| 5,275,400 | 1/1994 | Weingardt et al. | 273/85 CP |
| 5,280,909 | 1/1994 | Tracy | 273/138 A |
| 5,286,023 | 2/1994 | Wood . | |
| 5,287,269 | 2/1994 | Dorrough et al. | 364/408 |
| 5,292,127 | 3/1994 | Kelly et al. | 273/138 R |
| 5,321,241 | 6/1994 | Craine . | |
| 5,324,035 | 6/1994 | Morris | 273/138 |
| 5,326,104 | 7/1994 | Pease et al. | 273/138 A |
| 5,332,219 | 7/1994 | Marnell, II et al. . | |
| 5,344,144 | 9/1994 | Canon | 273/138 A |
| 5,345,379 | 9/1994 | Brous et al. | 364/146 |
| 5,351,970 | 10/1994 | Fioretti . | |
| 5,370,306 | 12/1994 | Schulze et al. | 273/138 A |
| 5,370,399 | 12/1994 | Liverance . | |
| 5,371,345 | 12/1994 | LeStrange et al. | 235/380 |
| 5,398,932 | 3/1995 | Eberhardt et al. . | |
| 5,401,024 | 3/1995 | Simunek . | |
| 5,410,590 | 4/1995 | Blood et al. . | |
| 5,429,361 * | 7/1995 | Raven et al. | 463/25 |
| 5,470,079 | 11/1995 | LeStrange et al. | 273/138 A |
| 5,472,194 | 12/1995 | Breeding et al. . | |
| 5,473,144 | 12/1995 | Mathurin, Jr. | 235/380 |
| 5,477,040 | 12/1995 | Lalonde | 235/380 |
| 5,488,411 | 1/1996 | Lewis . | |
| 5,494,287 | 2/1996 | Manz | 273/143 R |
| 5,507,489 | 4/1996 | Reibel et al. . | |
| 5,511,781 | 4/1996 | Wood et al. . | |
| 5,524,888 | 6/1996 | Heidel . | |
| 5,533,727 * | 7/1996 | DeMar | 463/25 |
| 5,536,016 | 7/1996 | Thompson | 273/269 |
| 5,542,669 | 8/1996 | Charron et al. . | |
| 5,550,359 | 8/1996 | Bennett | 235/382 |
| 5,551,692 | 9/1996 | Pettitt et al. | 273/143 R |
| 5,559,312 | 9/1996 | Lucero | 235/380 |
| 5,564,700 | 10/1996 | Celona | 463/27 |
| 5,577,959 | 11/1996 | Takemoto et al. | 463/25 |
| 5,580,309 | 12/1996 | Piechowiak et al. | 463/16 |
| 5,580,310 | 12/1996 | Orus et al. | 463/16 |
| 5,586,936 | 12/1996 | Bennett et al. | 463/25 |
| 5,586,937 | 12/1996 | Menashe . | |
| 5,603,659 | 2/1997 | Okada . | |
| 5,611,730 | 3/1997 | Weiss | 463/20 |
| 5,651,057 | 7/1997 | Blood et al. . | |
| 5,655,961 | 8/1997 | Acres et al. | 463/27 |
| 5,668,950 | 9/1997 | Kikuchi | 395/200.47 |
| 5,674,128 | 10/1997 | Holch et al. | 463/42 |
| 5,702,304 | 12/1997 | Acres et al. | 463/29 |
| 5,722,891 | 3/1998 | Inoue | 463/20 |
| 5,741,183 | 4/1998 | Acres et al. | 463/42 |
| 5,743,523 | 4/1998 | Kelly et al. | 273/138.1 |
| 5,752,882 | 5/1998 | Acres et al. | 463/42 |
| 5,758,875 * | 6/1998 | Giacalone, Jr. | 463/20 |
| 5,761,647 | 6/1998 | Boushy | 705/10 |
| 5,766,076 | 6/1998 | Pease et al. | 463/27 |
| 5,770,533 | 6/1998 | Franchi | 463/42 |
| 5,811,772 | 9/1998 | Lucero | 235/380 |
| 5,816,917 | 10/1998 | Kelmer et al. | 463/16 |
| 5,816,918 | 10/1998 | Kelly et al. | 463/16 |
| 5,820,459 | 10/1998 | Acres et al. | 463/25 |
| 5,833,540 | 11/1998 | Miodunski et al. | 463/42 |
| 5,836,817 | 11/1998 | Acres et al. | 463/26 |
| 5,839,956 | 11/1998 | Takemoto | 463/25 |
| 5,851,148 | 12/1998 | Brune et al. | 463/25 |
| 5,851,149 | 12/1998 | Xidos et al. | 463/42 |
| 5,854,542 | 12/1998 | Forbes | 315/291 |
| 5,902,983 | 5/1999 | Crevelt et al. | 235/380 |
| 5,919,091 | 7/1999 | Bell et al. | 463/25 |
| 6,012,982 | 1/2000 | Piechowiak | 463/16 |
| 6,039,648 | 3/2000 | Guinn et al. | 463/16 |
| 6,048,269 | 4/2000 | Burns et al. | 463/25 |
| 6,077,162 | 6/2000 | Weiss | 463/26 |

OTHER PUBLICATIONS

Expert Report of Michael J. Bennett Pursuant to Fed. R. Civ. P. 26(A)(2), Jul. 1999.

Expert Witness Report of Leroy A. Prohofsky, Feb. 1999.

Expert Witness Report of Leroy A. Prohofsky, Jun. 1999.

Supplement to Expert Witness Reports of Leroy A. Prohofsky, Jun. 1999.

Second Supplement to Expert Witness Reports of Leroy A. Prohofsky, Sep. 1999.

Rebuttal Statement by Expert Witness William K. Bertram, Ph.D., Mar. 1999.

Rebuttal Statement by Expert Witness John F. Acres, Jul. 1999.
Rebuttal Statement by Expert Witness William K. Bertram, Ph.D., Jul. 1999.
Expert Witness Report of R. Franklin Burnett, Jun. 1999.
Rebuttal Statement by Expert Witness Thomas F. Smegal, Jr., Jul. 1999.
CDS' Third Motion and Memorandum of Points and Authorities in Support of CDS' Motion for Summary Judgment of Invalidity of U.S. Patent No. 5,752,882 (On–Sale Bar).
Exihibits in Support of CDS' Third Motion and Memorandum of Points and Authorities in Support of CDS' Motion for Summary Judgment of Invalidity of U.S. Patent No. 5,752,882 (On–Sale Bar).
Acres Gaming's Opposition to CDS's Third Motion for Summary Judgment of Invalidity of U.S. Patent No. 5,752, 882 (On–Sale Bar).
Deposition of Jose Vega Dated Jan. 25, 1999 with Exhibit Nos. 191, 193, 194, 195, 197, 198.
CDS Motion and Memorandum of Points and Authorities in Support of CDS' Motion for Summary Judgment of Invalidity of US Patent No. 5,752,882 (On–Sale Bar) [Filed Under Seal—Subject to Protective Order].
Proposed Findings of Facts in Support of CDS' Memorandum of Points and Authorities in Support of CDS' Third Motion for Summary Judgment of Invalidity of U.S. Patent No. 5,752,882 (On–Sale Bar) [Filed Under Seal—Subject to Protective Order]; and.
Exhibits in Support of CDS' Motion and Memorandum of Points and Authorities in Support of CDS' Motion for Summary Judgment of Invalidity of U.S. Patent No. 5,752, 882 (On–Sale Bar), with Affidavit of Gregory C. Schodde [Filed Under Seal—Subject to Protective Order].
R. Stäuble, MPL 4215 Interface, Oct. 1991, pp. 1–16.
BYTE, Hardware/Software Showcase, Dec. 1992, p. 308.
Inder S. Gopal and Adrian Segall, IEEE Transactions on Communications, "Dynamic Address Assignment in Broadcast Networks," Jan. 1986, vol. Com–34, No. 1, pp. 32–37.
Fred Swainston, A Systems Approach to Programmable Controllers, 1992, pp. ix–226.
Acres Gaming Incorporated Form SB–2 filed with the Securities and Exchange Commission on Sep. 20, 1993.
Casino Data Systems and Sunset Station Hotel & Casino's ("CDS") Motion for Summary Judgment of Invalidity of U.S. Patent No. 5,752,882.
CDS' Memorandum of Points and Authorities in Support of CDS' Motion for Summary Judgment of Invalidity of U.S. Patent No. 5,752,882 [Filed In Camera—Subject to Protective Order].
CDS' Supplemental Brief Regarding CDS' First Motion for Summary Judgment of Invalidity.
CDS' Reply Memorandum in Support of CDS' Motion for Summary Judgment of Invalidity of U.S. Patent 5,752,882.
Casino Data Systems and Sunset Station Hotel & Casino's Evidence in Support of CDS' Motion for Summary Judgment of Invalidity and Opposition to Acres' Motion for Preliminary Injunction ("CDS Exhibits") [Filed In Camera—Subject to Protective Order].
Acres' Response to the Proposed Findings of Fact of Casino Data Systems Regarding CDS' Motion for Summary Judgment of Invalidity.
Acres Gaming, Inc.'s Opposition to Casino Data Systems' and Sunset Station Hotel and Casino's Motion for Summary Judgment.
Acres Gaming, Inc.'s Supplement to its Opposition to Casino Data Systems' and Sunset Station Hotel and Casino's Motion for Summary Judgment.
Acres Gaming, Inc.'s Second Supplement to its Opposition to Casino Data Systems' and Sunset Station Hotel and Casino's Motion for Summary Judgment.
Acres Gaming, Inc.'s Third Supplement to its Opposition to Casino Data Systems' and Sunset Station Hotel and Casino's Motion for Summary Judgment.
Expert Report of W. Alan Jorgensen Pursuant to Federal Rule of Civil Procedure 26(a)(2).
Expert Report of Samuel Wolff Pursuant to Federal Rule of Civil Procedure 26(a)(2).
Transcript of Motion for Summary Judgment of Invalidity of U.S. Patent No. 5,752,882 Before the Honorable Howard D. McKibben on Jan. 19, 1999.
Deposition of Disclosure, Inc. and Exhibits; and.
Additional Exhibits to deposition of Disclosure, Inc.

* cited by examiner

| | | | 1ST COIN | 2ND COIN | 3RD COIN |
|---|---|---|---|---|---|
| | | | 2000 | 4000 | 10000 |
| 7 | 7 | 7 | 400 | 800 | 1200 |
| 7 | 7 | 7 | 200 | 400 | 600 |
| 7 | 7 | 7 | 150 | 300 | 450 |
| 7 | 7 | 7 | 100 | 200 | 300 |
| ANY 7 | ANY 7 | ANY 7 | 50 | 100 | 150 |
| | BAR BAR | | 50 | 100 | 150 |
| | | | 40 | 80 | 150 |
| BAR BAR | BAR BAR | BAR BAR | 25 | 50 | 75 |
| ANY RED | ANY WHITE | ANY BLUE | 20 | 40 | 60 |
| | | | 10 | 20 | 30 |
| ANY BAR | ANY BAR | ANY BAR | 5 | 10 | 15 |
| ANY | TWO | | 5 | 10 | 15 |
| ANY RED | ANY RED | ANY RED | 2 | 4 | 6 |
| ANY WHITE | ANY WHITE | ANY WHITE | 2 | 4 | 6 |
| ANY BLUE | ANY BLUE | ANY BLUE | 2 | 4 | 6 |
| ANY | ONE | | 2 | 4 | 6 |
| BLANK | BLANK | BLANK | 1 | 2 | 3 |

FIG.6

METHOD AND APPARATUS FOR CONTROLLING THE COST OF PLAYING AN ELECTRONIC GAMING DEVICE

This application is a continuation of application Ser. No. 08/465,717, filed Jun. 6, 1995, which is a divisional of application Ser. No. 08/322,172, filed Oct. 12, 1994, now U.S. Pat. No. 5,655,961.

BACKGROUND OF THE INVENTION

1. Field of the Invention

The present invention relates to electronic gaming machines interconnected by a computer network and more particularly to a method of configuring such machines.

2. Description of the Related Art

Casinos typically include electronic gaming machines (EGMs) such as slot machines and video poker machines. The slot machines usually includes three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine.

Video poker machines include a video monitor upon which the images of cards appear, as if dealt by a dealer from a shuffled deck, in response to player inputs to the machine. The player wins jackpots dependent upon the amount wagered and in accordance with the cards that are dealt.

When a new EGM, whether a slot or poker machine, is made available for gaming, it must first be configured. A programmable read only memory (PROM) is installed in each new EGM. The PROM includes data that controls the behavior of the machine, and typically also includes data that establishes the payback percentage, such data being referred to herein as the paytable. The paytable defines the average percentage of wagers that is returned to the players in the form of jackpots over time. Gaming regulations in many jurisdictions require the paytable to be stored in the PROM. The PROM must consequently be changed if the casino desires to change the paytable. Some jurisdictions, however, permit the casino to change the paytable by setting options at each EGM. Such options are selected by using a key switch at each machine that places the machine into a configuration mode. When in this mode, the casino employee configures the machine for such things as the maximum jackpot that can be paid by the machine before a hand payment is required. The rate at which the jackpot meter increments may also be selected as well as special effects generated by the machine in response to a jackpot. And if the jurisdiction permits, the paytable may be changed when the machine is in the configuration mode. Otherwise, the only way to change the paytable is to replace the PROM with another containing a different paytable.

Poker machines, when placed in a configuration mode as described above, display information about the status of the various options on the video monitor that is used to display the cards and other information when the game is played. On the poker machine, sound, background color, and card decoration, which may be configured to display the casino's logo, are examples of the parameters that can be changed when the machine is in the configuration mode. It is easier to configure the poker machine because the monitor displays the status of various options as well as lists of options, from which a parameter can be selected and implemented. Slot machines, on the other hand, do not have a monitor and are therefore difficult to configure because the only displays available to indicate status are four digit alphanumeric readouts that are used to display the amounts on the credit meter or the jackpot meter. Configuring a slot machine as described above can take about twenty to thirty minutes of casino time. Installing machines in a new casino, which may number in the thousands, or changing the parameters on pre-existing machines, is consequently a very labor intensive process.

It is also a process that lends itself to implementing, either inadvertently or otherwise, the wrong parameters. Thus, a group of machines that are supposed to be configured identically may include one or more that vary from one another because of an incorrect input during the configuration process.

Some EGMs include a primary game and a secondary game. For example, the primary game may include a slot machine that periodically permits the player to play the secondary game before the next reel spin on the slot machine. Some secondary games award a prize after the player spins a wheel. The prize is indicated on a sector of the wheel, which stops at a random location after being spun. Because the secondary game must be configured in the same manner as the primary game, the same types of disadvantages are associated with secondary games.

In addition, some EGMs include a dedicated progressive in which a percentage of all wagers made on that machine goes into a separate pool that is awarded by the machine. The payback percentage for such a game must also be configured, either by the casino or via a paytable included in a PROM, and therefore presents similar problems.

It would be desirable for a casino operating a plurality of EGMs to be able to change the effective wager per unit time required of a player of the machines. The wager per unit time, which is the cost to the player for playing the EGMs, is a function of the payback percentage and the game speed. The faster the game speed and the lower the payback percentage, the more money the casino retains, and vice versa. Increasing the wager per unit time increases casino revenues—up to a point. If the casino simply selects a very low payback percentage (or a very fast game speed) on all of its machines, the players may feel that they get better returns elsewhere. It would, however, be desirable for the casino to be able to vary the wager per unit time in accordance with the demand on the casino floor. In other words, during evenings and into the early morning hours on weekends—and especially on certain holidays—there are greater numbers of players placing wagers than, e.g., on a Tuesday morning between 7:00 am and noon. It would therefore be desirable for the casino to set the cost to the player at a higher level during high demand periods and at a lower level, to attract players, during low demand periods.

It would be quite cumbersome to change payback percentage, either by switching the PROMs from machines, or by placing the machine in a configuration mode in jurisdictions that permit changing pay tables in response to casino configuration. Changing game speed by switching PROMs or by placing the machine in a configuration mode would be equally cumbersome. It would be impractical to make such changes in a large casino even weekly, much less daily.

In addition to varying the cost to the players, i.e., the wager per unit time, in response to periods of high and low demand in the casino, it would be desirable to change the player cost in response to the status of a particular player. The casino likes to track players to identify big players and to conduct direct mail marketing. Casino management therefore encourages players to sign up for, receive, and use a player tracking card, which the player inserts into a card reader associated with each EGM. The casino can therefore identify players based on previous or current rates of play and vary the wager per unit time for that player accordingly.

It might also be desirable to change the cost to the player depending upon their status as a person that the casino would like to encourage to play their games or as the companion of such a person or of a person known to wager large amounts. Changing player cost in response to player status by switching PROMs or reconfiguring the machines is not possible.

In addition to the foregoing it would be desirable to change the manner in which the player perceives the EGM. In other words, it would be desirable to change the sound effects and appearance of the machine in response to time, the rate at which the interconnected machines are played, or the status of a player.

SUMMARY OF THE INVENTION

The present invention comprises a method of configuring electronic gaming machines interconnected by a computer network to a host computer. Selected configuration parameters are implemented at each machine. A plurality of variables related to play on the gaming machines are monitored. A predetermined criterion for one of the variables is established. After play is permitted to occur at the machines, one of the machines is selected when the established criterion is met. The configuration parameter of the selected machine is changed in responsive to a computer command.

The present invention overcomes the disadvantages with associated with the prior art and provides additional advantages that are apparent when the detailed description is read in view of the accompanying drawings.

BRIEF DESCRIPTION OF THE DRAWINGS

FIG. 6 is a paytable for an electronic gaming machine.

DETAILED DESCRIPTION OF THE PREFERRED EMBODIMENT

Figure 1:
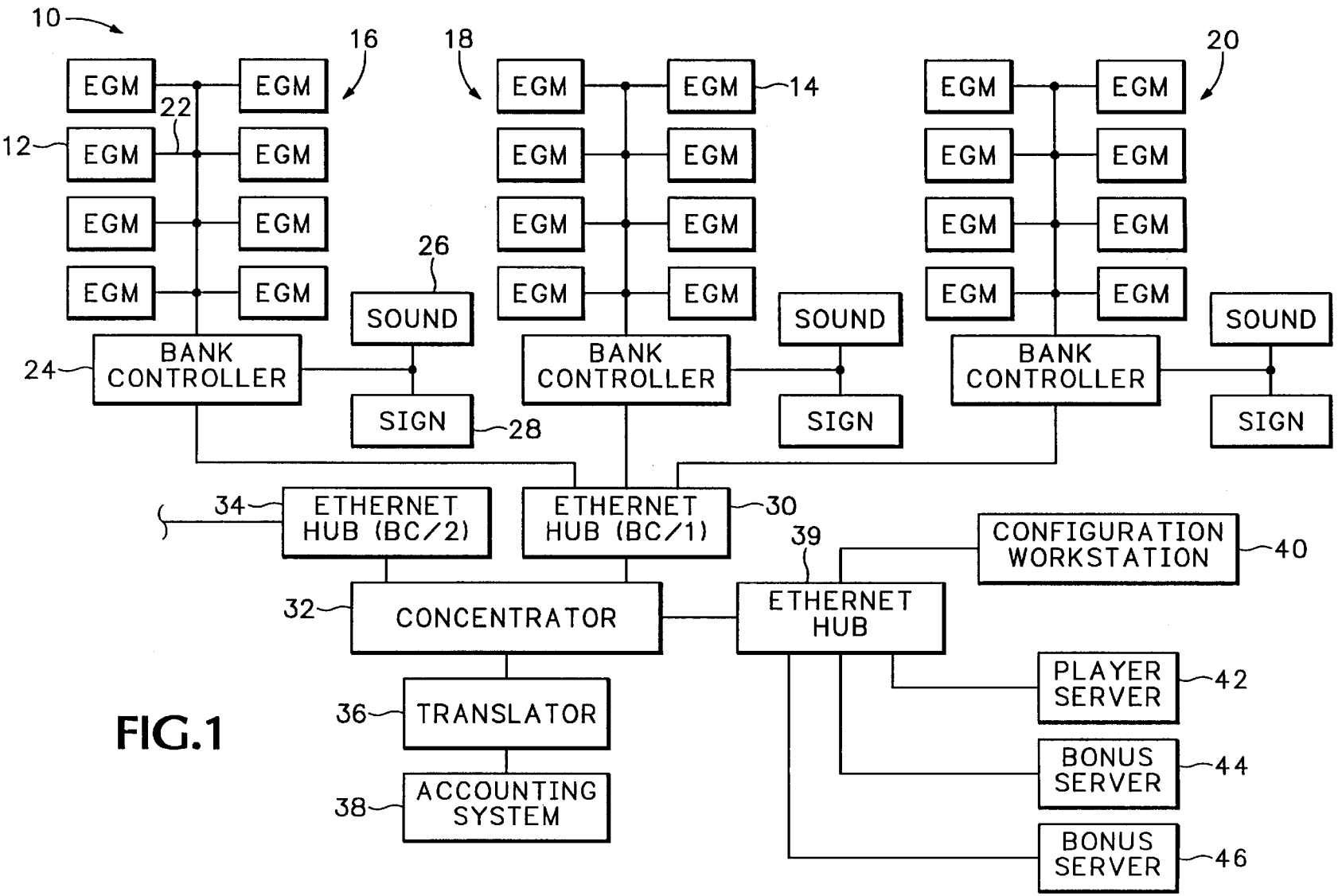
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a user interface. It comprises a personal computer including a keyboard, Intel Pentium Processor and Ethernet card.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to link to groups of EGMs operating in a progressive jackpot mode. Examples of bonuses that can be implemented on the network are disclosed in co-pending application Ser. No. 08/843,411, filed Apr. 15, 1997 and assigned to the Assignee of the present application (the '411 application), which is incorporated herein by reference for all purposes. This co-pending application also describes in more detail features of the network, like that shown in FIG. 1, that may be used to implement the present invention. Also incorporated herein by reference for all purposes is U.S. Pat. No. 5,655,961, assigned to the Assignee of the present application (the '961 patent), which also discloses bonuses that can be implemented by bonus servers 44, 46 and a network that could be used to implement the present invention.

Figure 2:
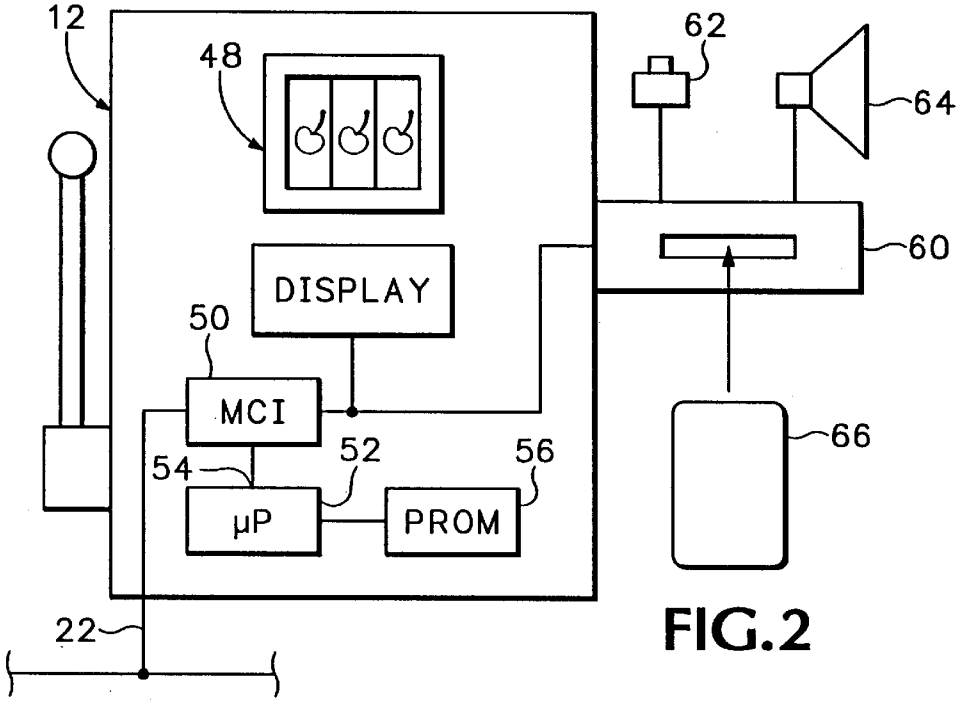
FIG. 2 is a schematic diagram of a slot machine and associated hardware implemented in accordance with the present invention.

FIG. 2 is a highly schematic representation of an electronic slot machine, which is typical of each of the machines in the network, that incorporates network communications hardware as described hereinafter. This hardware is described in the '961 patent, and is referred to therein as a data communications node. Preferably the network communications hardware is like that disclosed in the '411 application, which is referred to therein as a machine communication interface.

Included in EGM 12 are three reels, indicated generally at 48. Each reel includes a plurality of different symbols thereon. The reels spin in response to player input after a wager is made. FIG. 6 comprises the paytable for EGM 12. The first three columns depict different combinations of symbols on the reels. The fourth column of FIG. 6 indicates the amount won on a single coin wager when the combination of symbols in the first three columns appears after the reels spin. Columns five and six indicate the amount won when two and three coins, respectively, are wagered. Any combination of reel symbols other than those shown in FIG. 6 does not result in a payment to the player.

The network communications hardware preferably comprises a machine communication interface (MCI) 50 as set forth in the '411 application. MCI 50 facilitates communication between the network, via connection 22, and microprocessor 52, which controls the operation of EGM 12. This communication occurs via a serial port 54 on the microprocessor to which MCI 50 is connected. Microprocessor 52 is also connected to a programmable read only memory (PROM) 56, which controls the behavior of EGM 12, and which may or may not include the paytable of FIG. 6, depending upon how the present invention is implemented, as described hereinafter. MCI 50 may include a random access memory (RAM), which can be used as later described herein.

MCI 50 also facilitates communication between the network and a player display 58, a card reader 60, a player-actuated push button 62, and a speaker 64.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '411 application. Briefly summarizing such a system, a player registers with the casino prior to commencing gaming. The casino issues a unique player-tracking card to the player and opens a corresponding player account that is stored on accounting system 38 (in FIG. 1). The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

In another embodiment of the invention, EGM 12 in FIG. 2 can be operated in a stand-alone mode, i.e., without connection 22.

Consideration will now be given to the operation of the network and associated equipment depicted in FIGS. 1 and 2. First, selected configuration parameters are implemented at each EGM. As discussed above, these configuration parameters may be implemented by either (a) installing a PROM, like PROM 56 in FIG. 2, in each EGM to be configured or (b) by placing the EGM in a configuration mode and thereafter generating inputs to the EGM, or a combination of (a) and (b). Alternatively, and also in accordance with the present invention, configuration parameters can be implemented by generating computer commands at configuration workstation 40 that are transmitted via the network to a selected one or more of the EGMs. For example, and with reference to FIG. 2, such commands can be transmitted over the network to MCI 50 via connection 22. The commands may either reside in the random access memory (RAM) contained within MCI 50, or can be transferred to RAM (not shown) associated with EGM 12 via the serial port 54 of microprocessor 52. In the latter case, the code so transferred is received by microprocessor 52 and then stored in the EGM RAM.

In either case, whether stored in MCI 50 or in RAM associated with the EGM, the configuration parameters are accessible by microprocessor 52, which when programmed with the stored configuration parameters causes EGM 12 to operate in accordance with the parameters. As mentioned above, such configuration parameters control the behavior of the electronic gaming machine and may include the paytable that controls the average percent of money that the machines returns to players via jackpots.

Next, a plurality of variables related to play on the gaming machines are monitored. Such variables may include the rate at which the interconnected machines are played. The casino is therefore able to determine whether or not there is a relatively high level of demand for play or a relatively low level, i.e., the rate is relatively low. The casino's income, of course, increases with the rate of play.

Another variable comprises the time that the interconnected machines are played. The time variable may relate to a specific time of the day, the week, or the year. Each of these time periods includes portions in which play typically occurs at a high rate, e.g., evenings, Friday and Saturday nights, and three day weekends, and other portions in which play typically occurs at a low rate. The time variable may also relate to the length of time a particular configuration parameter has been implemented.

Still another such variable comprises the status of a player of one of the machines. The status of the player may comprise whether the player is recognized by a player-tracking system operated on the network. In the present embodiment of the invention this feature is implemented with player-tracking card 66 and card reader 60. Another aspect of the player status relates to the level of player play. One aspect of the level of player play includes the rate of play—both the current rate as well as the rate over a selected time period.

Next, a predetermined criterion is established for one of the monitored variables. For example, in connection with the player status, the predetermined criterion may comprise a predetermined level of player play, e.g., establishing a predetermined rate of player play. Another predetermined criterion relates to the level of money wagered on the entire system shown in FIG. 1, which is calculated by accounting system 38. This criterion could comprise the rate of money wagered on the entire system, as opposed to the criterion set forth above relating to the rate at which a single player wagers.

Another predetermined criterion may relate to the time. As noted above this could be the time that a particular configuration parameter has been implemented or could relate to the time of a day, week, or year.

After the predetermined criterion for one of the monitored variables is established, play is permitted to occur at the machines. When the monitored variable meets the criterion, one or more of the machines, or all, in FIG. 1 is selected, and a computer command is issued. In response to the computer command, a configuration parameter of the selected machine or machines is changed responsive to a command over the network.

Figure 3:
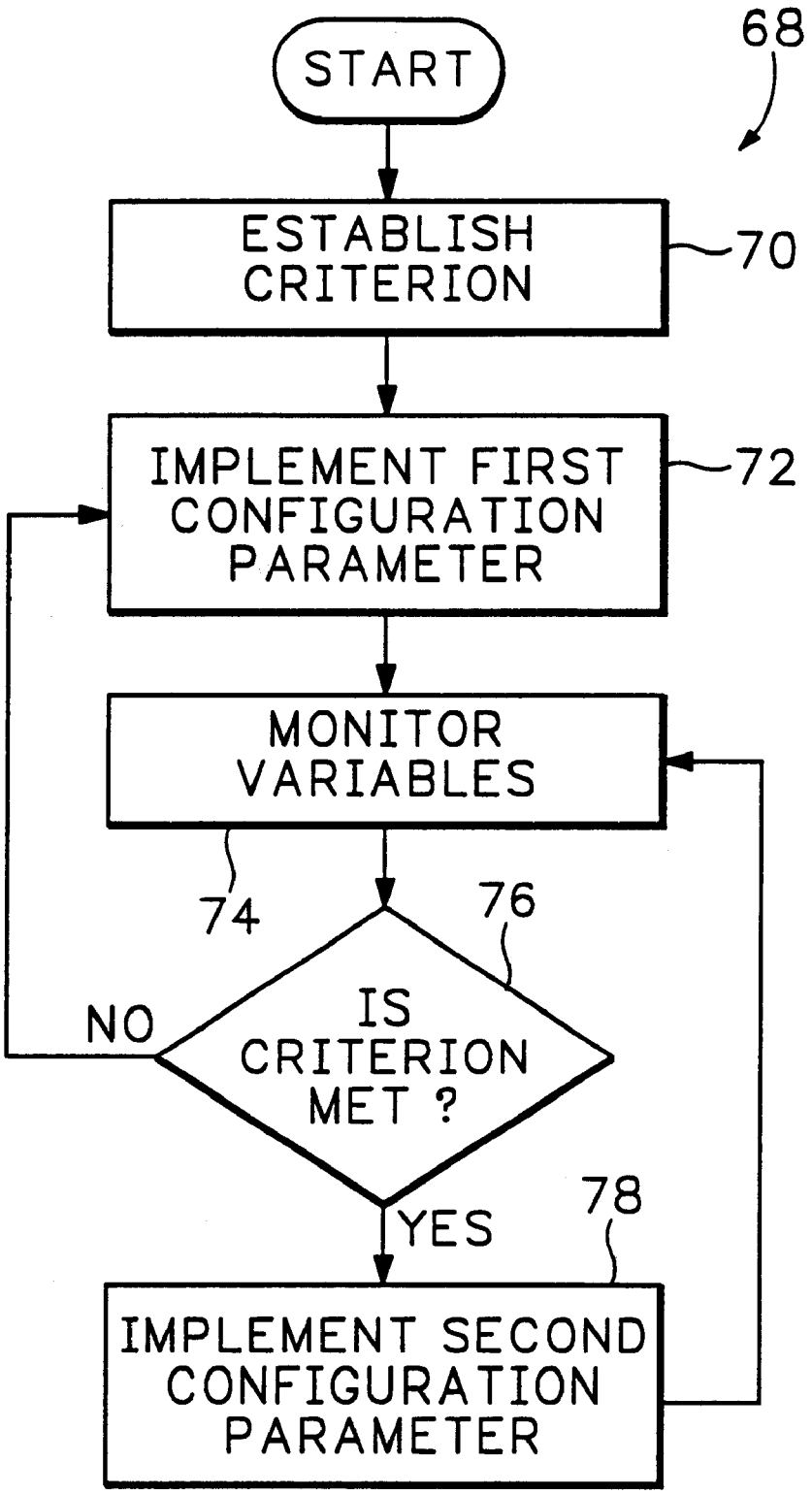
FIG. 3 is a flow chart that depicts operation of the FIG. 1 network in accordance with the present invention.

Attention is now directed to FIG. 3 wherein indicated generally at 68 is flow chart of a computer program implementing a portion of a preferred embodiment of the present invention. Computer program 68 is implemented in software installed on configuration workstation 40 in FIG. 1. First, a criterion is established in box 70. As discussed above, the criterion may relate to the rate at which the interconnected machines are played, the time the interconnected machines are played, or the status of a player of one of the machines. Next, a first configuration parameter is implemented in box 72. As discussed above, configuration parameters are implemented by installing a PROM provided by the EGM manufacturer, by generating inputs to the EGM when placed in the configuration mode, or by downloading configuration data delivered over the network of FIG. 1 to the EGM, or by a combination of the foregoing. Typically there is an initial configuration implemented via PROM or placing the EGM into a configuration mode. Implementation of initial configuration parameters, however, may be accomplished in any manner in accordance with the present invention.

In box 74, variables such as rate at which the machines are played, time that the machines are played, and the status of players, are monitored using the network of FIG. 1. In step 76 the program compares the monitored variables with the criterion established in block 70. If it is not met, the program maintains the first configuration parameter implemented in step 72 and continues to monitor variables in 74.

When step 76 determines that the criterion is met, a second configuration parameter is implemented in box 78. Thereafter the program monitors system variables in box 74 and so long as the criterion is met, maintains implementation of the second configuration parameter. When and if the criterion is not met, step 76 directs that the first configuration parameter be again implemented in box 72 with continued monitoring and comparison as before.

Considering now FIGS. 4 and 5, additional description will be made of examples of configuring electronic gaming machines in accordance with the present invention in which the predetermined criterion comprises the time that the interconnected machines are played and the changed configuration parameter comprises payback percentage.

Figure 4:
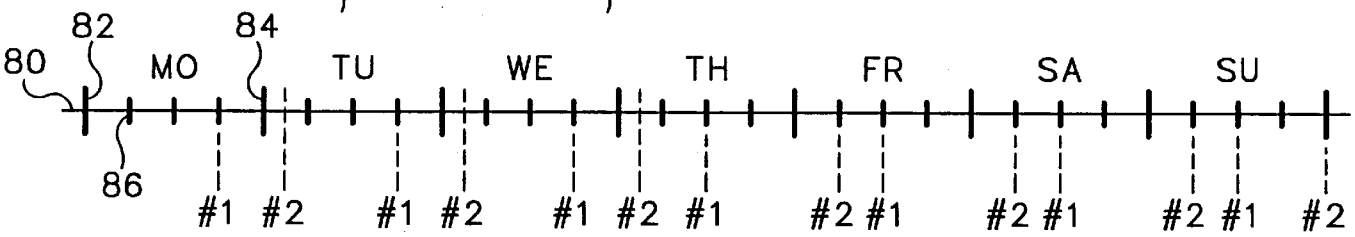
FIG. 4 is a exemplary time line for a one week period that shows changes in the player cost per unit time in response to the time of day.

In a first example, illustrated schematically in FIG. 4, the time that the interconnected machines are played relates to the time of an exemplary week. A time line 80 is bisected by long vertical lines, like lines 82, 84, which define a single 24 hour day. Each day of the week beginning with Monday and ending with Sunday, is identified on the time line. Each day is bisected by three short vertical lines, like line 86, that are equally spaced between long lines, like lines 82, 84. The distance from one short line to the next adjacent line therefore represents a 6 hour period. In the portion of time line 80 representing Monday, the short line corresponding to 6:00 pm is identified with a #1, as are the portions of the time line representing Tuesday and Wednesday. In the portion of the time line representing Tuesday, the time corresponding to 2:00 am is designated with a #2. This is also the case for Wednesday and Thursday.

Friday, Saturday, and Sunday similarly include times corresponding to numerals 1 or 2 as depicted.

In the example of FIG. 4, the time period defined between each number 1 and the following number 2 is referred to herein as a first time period. The time period between each number 2 and the following number 1 is referred to herein as a second time period. In this example, play on the machines is typically at a high level during the first time period and typically at a low level during the second time period. During the hours of the day, especially weekdays between around breakfast and midafternoon, play in some casinos is typically at a lower level than in the evening beginning around 6:00 pm. Similarly, play on the weekends during the day is at higher level than during weekdays.

The hours of the day defining the first and second periods in FIG. 4 are entered into configuration workstation 40. A computer command is issued at the start of each period. In response to the command, a payback percentage for one, or more, of the EGMs is implemented. In accordance with the present invention, this payback percentage may be implemented by delivering over the network to each affected machine a code that is stored in a memory associated with the machine and that changes the pay table of the machine. Because some jurisdictions would not permit changing the pay table on the machine, there is an alternative way to change the payback percentage to a selected machine or machines.

Using the alternative way, the network tracks the amount of money played on a selected gaming machine or machines that will have different payback percentages implemented. Responsive to the first command, a predetermined percentage of the money played on the selected machines is allocated to a bonus pool that is also tracked by the network. A bonus period is also initiated responsive to the first command. During the first period a bonus is paid to the machine or machines on which the first payback percentage is implemented. Such a bonus may be randomly awarded to one of these machines or may comprise an additional payment each time an EGM jackpot is paid in accordance with the first table. Such bonuses and the manner of implementing are described in the '961 patent. After play occurs on the machines, a second computer command is issued at the start of the second period. The second payback percentage for the selected machine or machines is implemented responsive to the second command. In this example, implementation of the second period is equivalent to turning the bonus off, i.e., money is no longer allocated to a bonus period during the second period and bonuses are not paid from the pool.

It can be seen that multiple criteria can be monitored. For example, at all times it might be desirable to provide a higher payback percentage to a player who uses a player-tracking card issued to him or her by the casino. For example, the bonus pool could always be accruing, and paying bonuses to each player using a valid player's card. Such a player would be eligible for still a higher level of bonus, i.e., additional percentage would accrue from all amounts wagered during the first period on the time line. Multiple and overlapping bonus pools could therefore be simultaneously accruing a percentage of wagers, and awarding bonuses from such pools, depending upon the rate of machine play, players status, and the time the interconnected machines are played.

Figure 5:
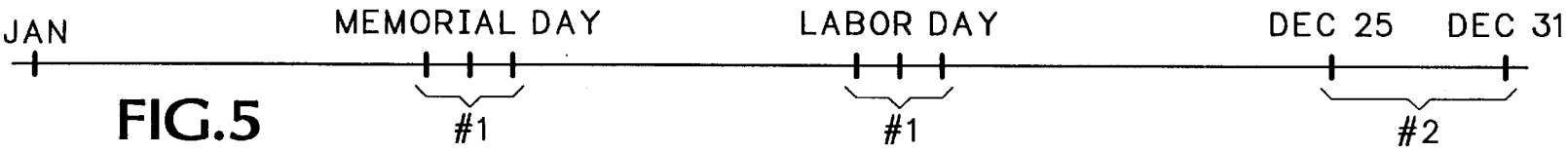
FIG. 5 is a exemplary time line for a one year period that shows changes in the player cost per unit time in response to the day of the year.

Turning now to FIG. 5, a second time line defines a year. With certain holidays, for example Memorial Day and Labor Day, play is typically high at all times throughout the three day weekend, with each day being represented by a vertical line in FIG. 5. The appropriate computer in FIG. 1 is therefore programmed to either override or alter the amount of the payback percentage change in the first and second periods of FIG. 4 during those weekends. In the example of FIG. 5, the period between December 25th and December 31st is traditionally a very slow time in some casinos so that the payback percentage could be correspondingly altered by either changing the amounts that would normally occur as a result of the parameters in FIG. 4 or substituting a different single one or multiple parameters for that period. It is to be appreciated that multiple variables may be monitored and multiple configuration parameters may be changed in response to the monitored variables.

Another configuration parameter comprises game speed. With respect to an electronic slot machine, the game speed is the time it takes from start of reel rotation until the reels stop spinning. With respect to electronic poker, the time relates to how fast the cards are "dealt," i.e., how rapidly they appear on the video monitor display. As discussed above, game speed, along with payback percentage and accrual of wagers in a bonus pool influence the net cost to the player per unit time for playing the casino games. Game speed is therefore one of the configuration parameters that may be changed in response to commands issued over the computer network in response to a predetermined criterion for one of the monitored variables. As with each of the other configurable parameters, an appropriate code input to the EGM serial port 54, delivered over the network and MCI 50, is used to change the game speed of the selected EGM.

Consideration will now be given to the operation of EGM 12 in stand-alone mode, i.e., with being connected to a network via connection 22. Initial configuration parameters are implemented as described above, either via installing PROM, by casino configuration, or by a combination of the two. In this embodiment, the RAM in MCI 50 is programmed to monitor variables related to play on the gaming machine, such as coin in, coin out, player status, time that machine is played, etc. The MCI also allocates a predetermined percentage of the money played on the gaming machine to a bonus pool. A predetermined criterion for one of the variables is stored in the MCI RAM. The MCI compares the monitored variable to the criterion and initiates a bonus period when the criterion is met. During the bonus period, the machine pays both from the pay table and from the bonus pool based on bonus rules that are stored in the MCI and implemented via communication with EGM processor 52. The bonus rules could provide for numerous types of payments via the EGM. The bonus could pay, for example, a specified amount from the pool in response to certain winning, or nonwinning, reel combinations. It could pay a multiple of any jackpot awarded by the EGM, or it could pay on a random basis. Numerous other rules could be established for paying from the bonus pool during a bonus period. As described above in connection with the networked implementation of the invention, this raises the payback percentage to a player of the gaming machine.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of configuring electronic gaming machines interconnected by a computer network to a host computer comprising:

implementing selected configuration parameters at each machine;

monitoring a plurality of variables related to play on the gaming machines, including whether a player of one of said machines is recognized by a player-tracking system operated on the network;

permitting play to occur at the machines;

selecting one of the machines when a player thereof is recognized by the player-tracking system;

issuing a computer command from the host computer; and changing a configuration parameter of the selected machine responsive to the command.

2. The method of claim 1 wherein the changed configuration parameter comprises game speed.

3. The method of claim 1 wherein the changed configuration parameter comprises payback percentage.

4. The method of claim 1 wherein the changed configuration parameter comprises game appearance.

5. The method of claim 1 wherein said method further comprises:

setting the payback percentage to a first level when the player is not recognized; and setting the payback percentage to a second level when the player is recognized.

6. A method of configuring electronic gaming machines interconnected by a computer network to a host computer comprising:

permitting play to occur at the machines;

selecting a plurality the machines;

issuing a computer command from the host computer;

tracking the amount of money wagered on the interconnected electronic gaming machines;

establishing a predetermined criterion relating to the level of tracked money; and changing the game speed of the selected machines when the level of tracked money satisfies the predetermined criterion.

7. The method of claim 6 wherein establishing a predetermined criterion relating to the level of tracked money comprises establishing a predetermined criterion relating to the rate of money wagered.

8. The method of claim 7 wherein said method further comprises decreasing the playing speed responsive to a first rate of money wagered and increasing the speed responsive to a second rate of money wagered.

9. The method of claim 6 wherein said method further comprises:

tracking the time;

establishing a predetermined criterion that is a function of the level of tracked money and the time; and changing the game speed of a plurality of the interconnected gaming machines when the level of tracked money and the time satisfies the predetermined criterion.

10. The method of claim 9 wherein the step of tracking the time comprises tracking the time of day.

11. The method of claim 9 wherein the step of tracking the time comprises tracking the day of the week.

12. The method of claim 9 wherein the step of tracking the time comprises tracking the date of the year.

13. The method of claim 6 wherein said method further comprises:

tracking a player of the gaming machines;

establishing a predetermined player criterion; and changing said game speed at each gaming machine where a player meets the criterion.

14. The method of claim 13 wherein the criterion comprises whether the player is recognized by a player-tracking system operated on the network.

15. The method of claim 13 wherein the criterion comprises determining whether the player is wagering at a predetermined rate.

16. A method of configuring electronic gaming machines interconnected by a computer network to a host computer comprising:

defining a first time period;

defining a second time period;

storing data representative of the first and second periods in the computer;

issuing a first computer command from the host computer at the start of the first period;

implementing a first payback percentage for one of the gaming machines responsive to the first command comprising paying responsive to a first payback schedule stored in the electronic gaming machine;

permitting play to occur on the machines;

issuing a second computer command from the host computer at the start of the second period;

implementing a second payback percentage for said one gaming machine responsive to the second command, comprising:

using the network to track the amount of money played on said one gaming machine;

allocating a predetermined percentage of the money played to a bonus pool;

initiating a bonus period responsive to the second command; and paying a bonus via said one gaming machine.

17. The method of claim 16 wherein said method further comprises communicating the second command to an input port of said one gaming machine via the network.

18. The method of claim 16 wherein paying the bonus via the gaming machine comprises paying a predetermined additional amount each time a payment is made in accordance with the first payout schedule.

19. The method of claim 16 wherein said method further comprises:

implementing a first payback percentage for a plurality of the gaming machines responsive to the first command;

implementing a second payback percentage for the plurality of gaming machines responsive to the second command;

using the network to track the amount of money played on the plurality of gaming machines; and paying the bonus via one of the plurality of gaming machines.

20. The method of claim 16 wherein defining first and second time periods comprises:

defining a first time period during which play on the machines is typically at a high level; and defining a second time period during which play on the machines is typically at a low level.

21. The method of claim 20 wherein said second payback percentage is higher than said first payback percentage.

22. A method of configuring an electronic gaming machine comprising:

implementing a pay table in the gaming machine;

monitoring a plurality of variables related to play on the gaming machine;

establishing a predetermined criterion for one of said variables;

permitting play to occur at the gaming machine;

tracking the amount of money played on the gaming machine;

allocating a predetermined percentage of the money played to a bonus pool;

initiating a bonus period when said one variable meets the criterion; and paying in accordance with said pay table and from said bonus pool via the gaming machine.

23. The method of claim 22 wherein said one variable comprises the rate at which the machine is played.

24. The method of claim 22 wherein said one variable comprises the time that the machine is played.

25. The method of claim 22 wherein said one variable comprises the status of a player of said machine.

26. The method of claim 25 wherein the status of a player comprises whether the player is a member of one of a plurality of classes.

27. The method of claim 22 wherein establishing a predetermined criterion for one of said variables comprises establishing a predetermined level of player play.

28. The method of claim 27 wherein establishing a predetermined level of player play comprises establishing a predetermined rate of play.

29. A method of configuring electronic gaming machines interconnected by a computer network to a host computer comprising:

implementing selected configuration parameters at each machine;

monitoring a plurality of variables related to play on the gaming machines, including whether a player of one of said machines is a member of one of a plurality of classes;

permitting play to occur at the machines;

selecting one of the machines when a player thereof is a member of one of said classes;

issuing a computer command from the host computer; and changing a configuration parameter of the selected machine responsive to the command.

30. The method of claim 29 wherein the changed configuration parameter comprises game speed.

31. The method of claim 29 wherein the changed configuration parameter comprises payback percentage.

32. The method of claim 29 wherein the changed configuration parameter comprises game appearance.

33. The method of claim 29 wherein the status of the player further comprises determining whether the player is recognized by a player-tracking system operated on the network.

34. The method of claim 33 wherein said method further comprises:

setting the payback percentage to a first level when the player is not recognized; and setting the payback percentage to a second level when the player is recognized.

35. A method of configuring electronic gaming machines interconnected by a computer network to a host computer comprising:

implementing a pay table in each machine;

monitoring a plurality of variables related to play on the machines;

establishing a predetermined criterion for one of said variables;

permitting play to occur at the machines;

tracking the amount of money played on the gaming machines;

allocating a predetermined percentage of the money played to a bonus pool;

initiating a bonus period when said one variable meets the criterion;

paying each gaming machine in accordance with said pay table whether or not the bonus period is in effect;

paying a bonus to one of said gaming machines during the bonus period;

ending the bonus period; and paying no bonuses to any of the gaming machines when the bonus period is not in effect.

36. The method of claim 35 wherein said one variable comprises the rate at which the machines are played.

37. The method of claim 35 wherein said one variable comprises the time that the machines are played.

38. The method of claim 35 wherein said one variable comprises the status of a player of one of said machines.

39. The method of claim 38 wherein said method further comprises:

issuing a unique identification card to a player of one of the gaming machines;

sensing engagement of the card with a reader associated with one of the gaming machines;

monitoring the player's play on said one gaming machine;

transmitting data relating to the player's play over the network; and storing the data on a computer connected to the network.

40. The method of claim 39 wherein the status of a player of one of said machines is reflected in the stored data and wherein establishing a predetermined criterion for one of said variables comprises establishing a predetermined level of player play.

41. The method of claim 40 wherein establishing a predetermined level of player play comprises establishing a predetermined rate of play.

42. The method of claim 38 wherein the status of a player comprises whether the player is a member of one of a plurality of classes.

43. The method of claim 38 wherein the status of the player comprises whether the player is recognized by a player-tracking system operated on the network.

44. The method of claim 35 wherein establishing a predetermined criterion for one of said variables comprises establishing a predetermined level of player play.

45. The method of claim 44 wherein establishing a predetermined level of player play comprises establishing a predetermined rate of play.

46. The method of claim 44 wherein said method further comprises indicating whether or not the gaming machine is being played at the predetermined level of play.

47. The method of claim 35 wherein said one variable comprises the amount of money in the bonus pool.

48. The method of claim 47 wherein said predetermined criterion comprises a predetermined amount of money accumulated in said bonus pool.

49. The method of claim 35 wherein paying a bonus to one of said gaming machines comprises randomly selecting one of said gaming devices and paying the bonus to the selected gaming device.

50. The method of claim 35 wherein paying a bonus to one of said gaming machines comprises paying a bonus to one of said gaming machine responsive to a jackpot at said one gaming machine.

51. The method of claim 22 wherein said one variable comprises the amount of money in the bonus pool.

52. The method of claim 51 wherein said predetermined criterion comprises a predetermined amount of money accumulated in said bonus pool.

53. A method of configuring electronic gaming machines interconnected by a computer network to a host computer comprising:

implementing a pay table in each machine;

monitoring a plurality of variables related to play on the machine, including the time that the machines are played;

establishing a predetermined criterion for the time that the machines are played;

permitting play to occur at the machines;

tracking the amount of money played on the gaming machines;

allocating a predetermined percentage of the money played to a bonus pool;

initiating a bonus period when said one variable meets the criterion;

paying each gaming machine in accordance with said pay table; and paying a bonus to one of said gaming machines.

54. A method of configuring electronic gaming machines interconnected by a computer network to a host computer comprising:

implementing a pay table in each machine;

monitoring a plurality of variables related to play on the machines;

establishing a predetermined criterion for one of said variables;

permitting play to occur at the machines;

tracking the amount of money played on the gaming machines;

allocating a predetermined percentage of the money played to a bonus pool;

initiating a bonus period when said one variable meets the criterion;

paying each gaming machine in accordance with said pay table; and paying a bonus to one of said gaming machines responsive to a jackpot at said one gaming machine.

* * * * *